US010222000B2

(12) United States Patent
Gershtein et al.

(10) Patent No.: US 10,222,000 B2
(45) Date of Patent: Mar. 5, 2019

(54) VESSELS WITH PERSONNEL ACCESS PROVISIONS

(71) Applicant: VERSUM MATERIALS US, LLC, Tempe, AZ (US)

(72) Inventors: Vladimir Yliy Gershtein, Allentown, PA (US); Christopher R. Butler, Allentown, PA (US)

(73) Assignee: VERSUM MATERIALS US, LLC, Tempe, AZ (US)

( * ) Notice: Subject to any disclaimer, the term of this patent is extended or adjusted under 35 U.S.C. 154(b) by 0 days.

(21) Appl. No.: 14/961,207

(22) Filed: Dec. 7, 2015

(65) Prior Publication Data

US 2016/0084444 A1 Mar. 24, 2016

Related U.S. Application Data

(62) Division of application No. 11/944,788, filed on Nov. 26, 2007, now Pat. No. 9,222,622.

(51) Int. Cl.

| | |
|---|---|
| ***B65D 90/10*** | (2006.01) |
| ***F17C 13/04*** | (2006.01) |
| ***F17C 13/06*** | (2006.01) |

(52) U.S. Cl.

CPC ..... *F17C 13/04* (2013.01); *B65D 90/10* (2013.01); *B65D 90/105* (2013.01); *F17C 13/06* (2013.01); *F17C 2201/0104* (2013.01); *F17C 2201/0109* (2013.01); *F17C 2201/0166* (2013.01); *F17C 2201/035* (2013.01); *F17C 2201/052* (2013.01); *F17C 2201/054* (2013.01); *F17C 2203/0612* (2013.01); *F17C 2203/0617* (2013.01); *F17C 2205/0311* (2013.01); *F17C 2205/0323* (2013.01); *F17C 2205/0379* (2013.01); *F17C 2209/221* (2013.01); *F17C 2221/05* (2013.01); *F17C 2223/0123* (2013.01); *F17C 2223/0153* (2013.01); *F17C 2223/033* (2013.01); *F17C 2260/015* (2013.01); *F17C 2260/036* (2013.01); *F17C 2270/05* (2013.01); *F17C 2270/0518* (2013.01); *Y10T 137/0441* (2015.04)

(58) Field of Classification Search

CPC ..... B65D 90/10; B65D 90/105; F17C 13/06
See application file for complete search history.

(56) References Cited

U.S. PATENT DOCUMENTS

| | | | |
|---|---|---|---|
| 2,102,124 | A | 12/1937 | Lithgow |
| 2,294,176 | A | 8/1942 | Gredell |
| 2,511,789 | A | 6/1950 | Horelick |
| 2,544,789 | A | 3/1951 | Horelick et al. |

(Continued)

FOREIGN PATENT DOCUMENTS

| | | | |
|---|---|---|---|
| CN | 2734680 | Y | 10/2005 |
| CN | 2813514 | Y | 9/2006 |

(Continued)

OTHER PUBLICATIONS

IMDG International Maritime Dangerous Goods Code 2006 Edition, vol. 1.

(Continued)

*Primary Examiner* — Shawn M Braden
(74) *Attorney, Agent, or Firm* — Anne B. Kiernan

(57) ABSTRACT

Embodiments of vessels include personnel access provisions having welded or otherwise permanent connections that substantially reduce the potential for leakage into or out of the vessels by way of the personnel access provisions.

19 Claims, 7 Drawing Sheets

(56) References Cited

U.S. PATENT DOCUMENTS

| | | | |
|---|---|---|---|
| 2,760,670 | A | 8/1956 | Moore |
| 3,339,791 | A | 9/1967 | De Frees |
| 3,456,831 | A | 7/1969 | Johansson |
| 4,524,729 | A | 6/1985 | Hill, Jr. et al. |
| 4,552,166 | A | 11/1985 | Chadbourne, Jr. |
| 4,655,361 | A | 4/1987 | Clover et al. |
| 4,685,585 | A | 8/1987 | Robbins |
| 4,762,440 | A | 9/1988 | Argandona |
| 4,807,675 | A | 2/1989 | Sharp |
| 4,958,742 | A | 9/1990 | Berwald et al. |
| 4,986,436 | A | 1/1991 | Bambacigno et al. |
| 5,056,680 | A | 10/1991 | Sharp |
| 5,097,976 | A | 3/1992 | Zink et al. |
| 5,170,819 | A | 12/1992 | Chronister |
| 5,251,658 | A | 10/1993 | Zink |
| 5,425,466 | A | 6/1995 | Bambacigno |
| 5,501,243 | A | 3/1996 | Palazzo |
| 5,595,319 | A | 1/1997 | Householder et al. |
| 5,944,300 | A | 8/1999 | Gillard et al. |
| 6,019,253 | A | 2/2000 | Gillard et al. |
| 6,637,469 | B2 | 10/2003 | Hoffman et al. |
| 6,742,550 | B2 | 6/2004 | Caparros |
| 6,938,654 | B2 | 9/2005 | Gershtein et al. |
| 6,938,659 | B2 | 9/2005 | Whitney |
| 2003/0178093 | A1 | 9/2003 | Gershtein et al. |
| 2007/0125259 | A1 | 6/2007 | Dalrymple |

FOREIGN PATENT DOCUMENTS

| | | | |
|---|---|---|---|
| CN | 2905697 | Y | 5/2007 |
| CN | 200971247 | Y | 11/2007 |
| CN | 200974694 | Y | 11/2007 |
| DE | 3142674 | A1 | 5/1983 |
| EP | 1351013 | A2 | 10/2003 |
| EP | 1 522 786 | A2 | 4/2005 |
| FR | 2492050 | A1 | 4/1982 |
| JP | 56-047113 | | 12/1977 |
| JP | 57-043836 | | 11/1980 |
| JP | 57-142889 | | 9/1982 |
| JP | 3105496 | A2 | 5/1991 |
| JP | 4037115 | A2 | 2/1992 |
| JP | 1999-182790 | | 7/1999 |
| JP | 2000-313495 | A | 11/2000 |
| JP | 2003-095382 | A | 4/2003 |
| JP | 2005-114168 | A2 | 4/2005 |
| JP | 2006-142889 | | 6/2006 |
| JP | 2006-226476 | | 8/2006 |
| TW | 571045 | | 1/2004 |

OTHER PUBLICATIONS

CSC International Convention for Safe Containers, 1972, as amended, 5th Edition (1993).

VESSELS WITH PERSONNEL ACCESS PROVISIONS

CROSS-REFERENCE TO RELATED APPLICATIONS

This application claims priority to nonprovisional application U.S. Ser. No. 11/944,788, entitled "Vessels with Personnel Access Provisions," filed Nov. 26, 2007, the contents of which are hereby incorporated by reference.

BACKGROUND OF THE INVENTION

The present invention relates to containers or vessels used to hold and ship specialty and other materials such as high-purity (HP) and ultra-high-purity (UHP) fluids.

New developments and enhancements in technologies utilized in the electronics industry are leading to demands for increasing quantities of specialty materials such as HP and UHP fluids used in manufacturing processes. Specialty materials are chemicals used in manufacturing processes, such as the manufacture of electronic components, that exhibit certain properties such as high purity or ultra high purity. Specialty materials can be, for example, powders, emulsions, suspensions, and vapors. The term "fluids," as used herein, is intended to encompass gases, liquids, sublimed solids, and combinations thereof.

Specialty materials used for different processes and treatment of associated production equipment may require delivery of products with impurities measured at the ppb level. Even though specialty gases and chemicals may account for only about 0.01 to about 0.1 percent of production expenses, a shortage of these materials can jeopardize the ability to maintain desired or required production volumes in, for example, electronics manufacturing facilities. In some cases, using contaminated product in a manufacturing process may jeopardize the final product specifications. The specifications of the final product may be determined at the very last stage of the manufacturing processes. For example, in the case of wafer production, the specifications of the final product may be checked during a product quality assurance procedure. Produced wafers may be considered "out of spec" and may be thrown away, which can account for the losses of many millions of dollars. Therefore, preserving the purity of specialty materials during delivery is of substantial importance.

Contamination of a vessel used to hold an HP or UHP fluid or other specialty material can be characterized as the presence of substances that can compromise a pre-defined purity level of the specialty material upon introduction of the specialty material into the vessel, or the penetration of the impurities into the vessel during transportation and/or storing of the high purity products in the vessel.

Contaminants can take the form of solids, liquids, and gases. Contaminants can be formed, for example, by residue from another type of material previously stored in the vessel. Contaminants can also be introduced by, for example, infiltration of ambient air into the internal volume of the vessel due to leaks in the vessel. More particularly, oxygen introduced by ambient-air infiltration is generally considered a contaminant with respect to HP and UHP fluids and other specialty materials used in the manufacture of electronics. The oxygen can form contaminating oxides on the interior surfaces of the vessel. Moreover, oxygen molecules can be trapped on the internal surfaces of the vessel, and can diffuse into the HP or UHP fluid or other specialty material which is subsequently placed in the vessel. As the HP or UHP fluid resides in a vessel, the oxygen molecules can be drawn out of the vessel internal surfaces due to a concentration gradient with the HP or UHP fluid and carried into the production facility, adversely affecting the final product specification.

Substances characterized as contaminants for a specialty material are application-dependent, and can vary with factors such as the specific type of specialty material, the product specification of the specialty material, and the intended use of the specialty material. Thus, a substance considered a contaminant in one application may not be considered a contaminant in other applications. For example, oxygen, hydrocarbons, metal particles, water, and nitrogen are considered contaminants of supercritical carbon dioxide ($SCCO_2$). Nitrogen is not considered a contaminant, however, of electronics-grade gases such as $NH_3$, $NF_3$, and $Cl_2$.

In some cases, the older delivery methods for delivering small quantities of HP and UHP materials may no longer be applicable. For example, deliveries using cylinder bottles or other small packages may no longer be acceptable in some manufacturing processes due to the need for relatively large quantities of such materials. For example, demands for ultra-high purity "White Ammonia" ($NH_3$) and high purity nitrogen-triflouride ($NF_3$) have grown significantly in recent years, and bulk quantities of these materials are now required in many different manufacturing processes.

Bulk delivery vessels and systems for delivering HP and UHP materials were not known or used in the recent past. Only the recent development of new technologies, for example, technologies used for production of various electronic devices, have lead to the demand for large quantities of HP and UHP products such as $NF_3$, $NH_3$, $Cl_2$, HCl, and other specialty gases and chemicals. Small containers such as bottle cylinders were used in the past for delivery of relatively small quantities of HP and UHP products. Requirements for the preparation of small containers, while stringent, can be met relatively easily. Indeed, container preparation procedures for relatively small containers and vessels which are used to transport HP and UHP products are well known. For example, a simple container heating process in an oven, known as "baking," helps to achieve the required purity of container internal surfaces. Prepared or so called "purity treated" containers may receive UHP products without the threat of contaminating the UHP products. "Baking" ovens used for container heating may vary in size and shape, but typically are restricted to the preparation of relatively small containers such as cylinders.

Large size containers or vessels, such as those necessary for the delivery of industrial gases in bulk quantities, cannot utilize the preparation methods for relatively small containers. New container preparation methods for bulk HP and UHP products have been developed and introduced to the container industry. For example, preparation of ISO containers of about 6,000-pound capacity is described in U.S. Pat. Nos. 6,616,769B2 and 6,814,092B2, titled "Systems and Methods for conditioning Ultra High Purity Gas Bulk Containers." The preparation of these containers is much more complex than the preparation of smaller containers because the larger containers are too large to fit into existing "baking" ovens, and also because maximum surface temperature of the containers is regulated by national transportation bodies, agreements, and conventions including, for example, the U.S. Department of Transportation (DOT), the United Nations (UN), the International Maritime Dangerous Goods (IMDG), the European Agreement Concerning the Carriage of Dangerous Goods by Road (ADR), the Convention for Safe Containers (CSC), etc. In other words, large containers used as transport vessels are regulated by transportation organizations around the world. For example, according to DOT recommendations, the maximum outside temperature of a portable ISO tank T50 type should not exceed 125° F., to avoid introducing thermal stresses and fatigue in tank. Apparently, a "baking" process cannot be performed since baking requires significantly higher temperatures to achieve adequate container surface preparation.

Methods for cleaning and preparing large size vessels for delivery of HP and UHP products are known and are in practice in the industry. These methods are quite involved and require significant effort and expense. Therefore, preservation of container purity is essential, and may significantly influence both delivered HP or UHP product revenue and quality of the devices produced using the delivered HP or UHP materials. For example, various steps of the manufacturing process for semiconductor wafers may rely on the use of delivered HP and UHP substances such as $NF_3$, $NH_3$, $CO_2$, etc.

Significant effort has been undertaken to develop and implement delivery systems and means for HP and UHP materials in bulk quantities. One of the important challenges associated with these deliveries has been the design and preparation of bulk containers in a way that these containers may be used to transport and deliver the required product purity without jeopardizing the latter. Some unique vessel designs and preparation procedures are known today. The task of container design and preparation to satisfy the handling of high purity substances is somewhat less complex in the case of stationary containers. For portable containers, however, the task of achieving and preserving product purity is more challenging. Portable containers need to comply with various regulations imposed not only by standards regulating container materials, design, and mechanical properties, but also by different national transportation bodies around the world including, for example, DOT, UN, IMDG, ADR, CSC, etc. The job of these bodies and their regulations is to make sure that portable containers carrying bulk quantities of different materials do not impose danger to the surrounding world during the transportation process. Container design, inspection, transportation, and other handling procedures are strictly regulated, and all containers that fail to comply with existing regulations are not permitted to be used for transporting dangerous goods. At the same time, some of the container design, preparation, and inspection procedures contradict high purity product requirements.

One would need to understand the requirements that are imposed on transportable containers to understand what may and may not be done to a standard container design, a regulated container preparation process, an inspection procedure, etc. New or modified container designs, as well as new or modified preparation and inspection procedures may need to be approved for use by national transportation bodies. An example of some of the inspection-related requirements imposed on containers is shown in the section "ISO Inspection Requirements" of ITCO ACC MANUAL issue No. 3: January 2003, which states: "[f] or man entry it is the responsibility of depot supervisor to ensure that the tank is safe to enter. This may require an inspection for gas contamination of low oxygen." This statement taken from the container inspection manual means that in the case of man entry to the tank (container), appropriate conditions are required to ensure that no hazardous gas residue is left inside the container, and the oxygen deficient atmosphere is eliminated. The latter may require an air purge if the container which may be a source of major container contamination forming, for example, metal oxides and other undesirable residue. In addition, a thorough container preparation (decontamination) procedure will be required to eliminate residual oxygen even after the container is purged with inert gas. Container surfaces may trap significant amount of oxygen which would be enough to contaminate a UHP product subsequently introduced into the container. An example of a quite involved container preparation method is described, for example, in U.S. Pat. No. 6,616,769B2. Thus, a substantial amount of time, energy, and money can be saved by avoiding the need for container preparations whenever possible.

Another example of regulated container inspection requirements may be found in chapter "Pressure Vessel Not Acceptable Conditions" of the ITCO ACC MANUAL issue No. 3: January 2003. For example, the following vessel conditions found during the inspection may qualify the inspected vessel as unacceptable for further use:

- defects to welds or parent materials
- body executed grinding, deeper than 0.1 mm (0.004 inch)
- Excessive grinding or other metal depletion which reduces the shell thickness to less than the minimum
- Corrosion or pitting which results in an shell thickness below the required minimum or create contamination traps
- Stress corrosion
- Sharp indentations, creases, or dents . . .
- Dents grater then 6 mm (0.25 inch) to the top third of the tank shell
- Dents grater then 10 mm (0.4 inch) to the bottom two thirds of the tank shell To comply with the above-listed conditions, a rigorous internal container inspection is required. The inspection may involve not only visual qualitative analyses of the container internal surfaces, but also the actual measurement of possible surface discontinuities, particle sizes, shape of the internal structure, etc. Under today's standard practices, human entry into an inspected vessel is practically inevitable in order to achieve the required inspection quality. That is why the industry accepted and established standard requires a container entry by an inspector through the manway associated with internal container inspections. Thus, the size of a manway, and often its position as well, are regulated to ensure safe entry and exit into and out of a confined space by the inspector.

Another document which establishes requirement for containers shipped around the world has been developed by the UN. For example, UN type T50 Portable ISO Tanks used in International transport for the carriage and use of anhydrous Ammonia UN 1005. These are portable tanks meeting the definition of container in the International Convention for Safe Containers (CSC), 1972, as amended, and are subject to inspection and test in accordance with UN Model Regulations 6.7.3.15 et al. and the CSC. The document imposes strict requirement on conducting container inspections, as well as prescribing stringent time requirements for conducting these inspections. For example, the document states: " . . . A portable tank may not be filled after expiration of the last 2.5 or 5 year test date. A tank filled within the test date may be transported up to 3 months beyond the date of expiry of the last periodic test date . . . ." Apparently, containers which have not had the inspection completed on time or have not passed the inspection may not be used for delivery of goods internationally. In the United States, similar regulations developed by DOT. The CSC regulations on container inspection and maintenance are addressed in the CSC regulation #2. For example: " . . . The first examination must occur no later than 5 years after production and then at least every 2.5 years thereafter . . . ." In addition, the inspection regulations like CSC specify who may perform the inspection. The presence of qualified and licensed representatives is essential, and only these representatives may perform the inspection and eventually pass or fail the container for further use. The following is also stated in another section of the CSC document: " . . . The inspection and tests described herein must be performed or witnessed by an inspector/agency qualified and approved by the competent authority or its authorized body. The CSC and the UN tank test and inspection may be performed by the same inspector if they are suitably qualified to do so. Typical agencies approved to perform this work are: ABS, Bureau Veritas, Lloyds Register etc. . . . ." In practice, the requirements in the last example demand that a qualified inspector should enter the container and perform the inspection. The final verdict on whether the container may continue to be used in service may be issued only upon completion of the inspection. Unfortunately, none of the qualified inspection agencies are intimately familiar with requirement for containers and systems transporting and supplying HP and UHP products. Therefore, the inspectors may be qualified to perform the inspection of the containers, but they may not be qualified to enter the container transporting HP or UHP goods.

Vessels used to hold and transport bulk quantities of HP and UHP gases and other specialty materials typically include various external valves. The valves can be used for functions such as pressure relief; transfer of material into, out of, and within the vessel, etc. The valves are usually located in a valve box mounted on the shell of the vessel. The valve box helps to protect the valves from damage caused by the valves being struck, crushed, pulled, etc. Moreover, the valve box can be covered so that a blanket of gas can be maintained within the valve box. The gas can be non-contaminating with respect to the material that is held in the vessel, so that infiltration of the gas past the valves and into the interior of the vessel will not contaminate the material within the vessel.

Manways are often integrated with the valve boxes in vessels used to transport bulk quantities of HP and UHP gases and other specialty materials. In particular, the bottom of the valve box is typically secured to a flange or other suitable mating point on the remainder of the valve box by fasteners, so that the bottom of the valve box can be removed to provide access to the internal volume of the vessel.

A valve box that may function as a manway needs to be sufficiently large to facilitate the passage of an adult-sized human therethrough. For example, valve boxes that may function as manways typically have a diameter of at least approximately 2.5 feet. Thus, the interface between the removable bottom of the valve box and the flange or other mating point on the remainder of the valve box is relatively large. Maintaining an airtight seal across such a relatively large interface can be difficult, particularly in transportable vessels that are typically subjected to mechanical shocks, vibrations, and temperature swings during transportation. Thus, leakage across the seal of a manway located at the bottom of a valve box represents a potential source of contamination in a vessel used to hold and transport bulk quantities of HP and UHP gases and other specialty materials.

An ongoing need therefore exists for a substantially leak-free personnel access provision for a vessel used to transport bulk quantities of specialty materials such as HP and UHP gases.

BRIEF SUMMARY OF THE INVENTION

Embodiments of vessels include personnel access provisions having welded or otherwise permanent connections that substantially reduce the potential for leakage into or out of the vessels by way of the personnel access provisions.

Embodiments of vessels comprise a shell defining an internal volume; a sleeve mounted on the shell and defining a passage that facilitates personnel access to the internal volume; and a cover that covers the passage and is connected to the sleeve by a weld.

Embodiments of vessels capable of holding and transporting high-purity and ultra-high-purity gases comprise a shell; a hollow sleeve mounted on and extending through the shell; and a cover permanently connected to an end of the sleeve.

Methods are provided for accessing an internal volume of a vessel. The vessel comprises a shell that defines the internal volume, a sleeve connected to the shell and defining a passage from outside of the vessel to the internal volume, and a cover connected to the sleeve by a weld and covering the passage. The methods comprise cutting the weld; moving the cover away from the passage; and entering the internal volume by way of the passage.

BRIEF DESCRIPTION OF SEVERAL VIEWS OF THE DRAWINGS

The foregoing summary, as well as the following detailed description of preferred embodiments, are better understood when read in conjunction with the appended drawings. The drawings are presented for illustrative purposes only, and the scope of the appended claims is not limited to the specific embodiments shown in the drawings. In the drawings:

DETAILED DESCRIPTION OF THE INVENTION

Figure 1:
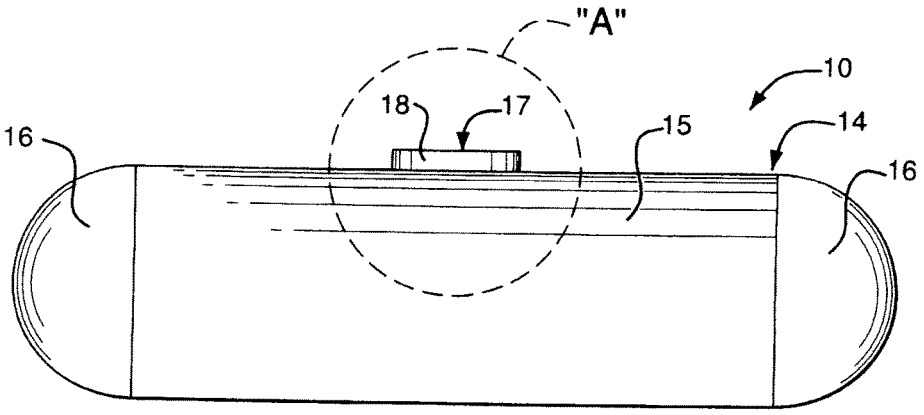
FIG. 1 is side view of an embodiment of a vessel having a personnel access provision in the form of a valve box.
Figure 2:
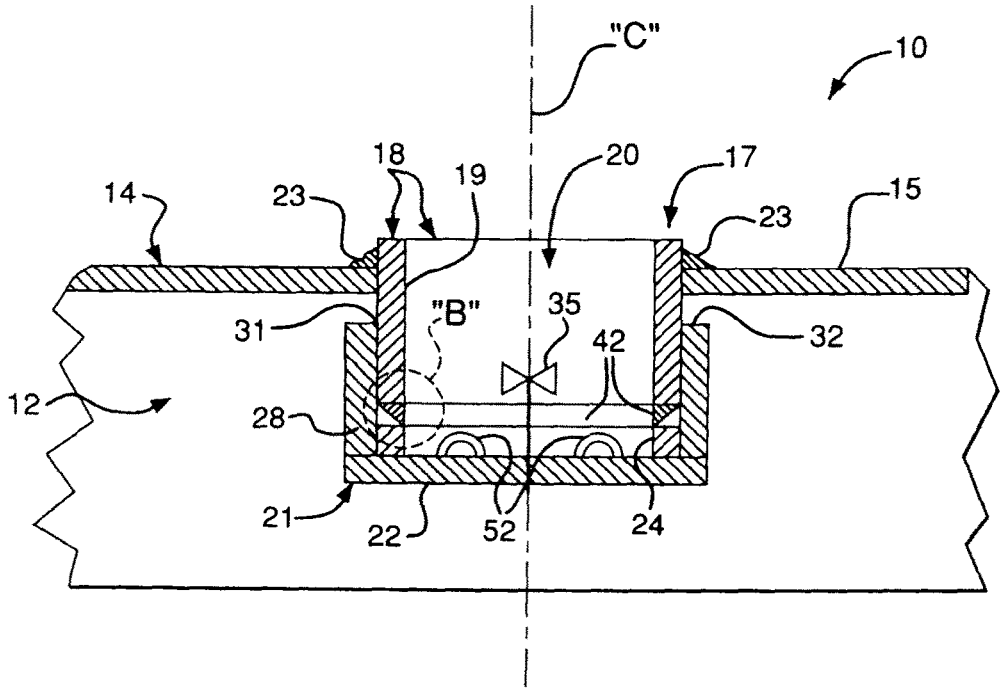
FIG. 2 is a magnified, cross-sectional view of the area designated "A" in FIG. 1.
Figure 3:
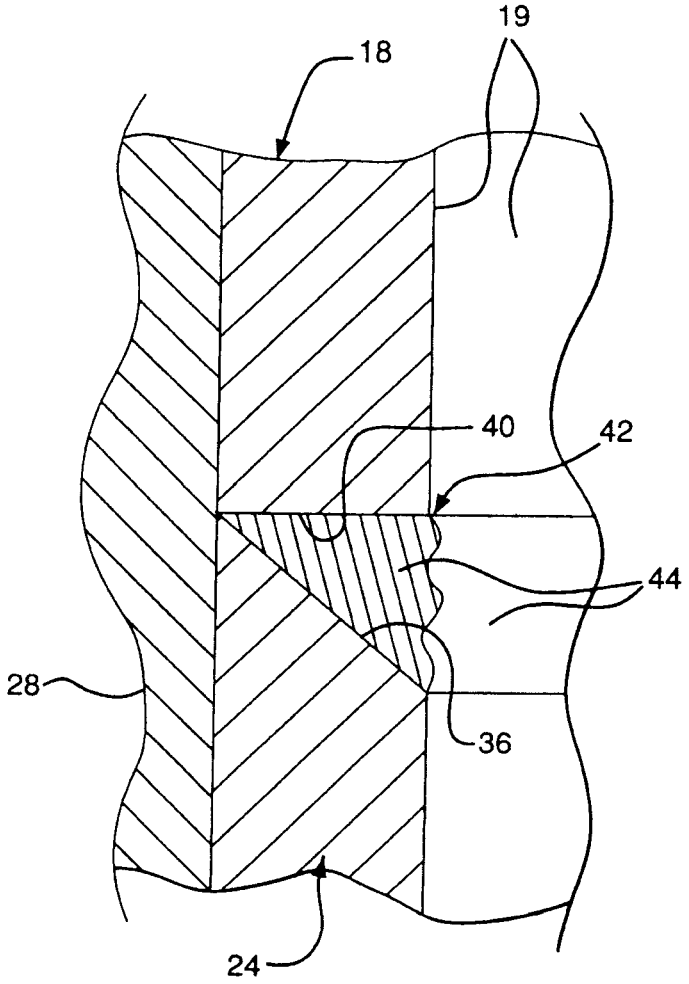
FIG. 3 is a magnified view of the area designated "B" in FIG. 2.

FIGS. 1 to 3 depict an embodiment of a transportable container or vessel 10 having an internal volume 12. The vessel 10 can be used, for example, to hold a specialty material such as an HP or UHP gas.

The vessel 10 comprises a shell 14. The shell 14 can include a substantially cylindrical main portion 15, and two end portions or heads 16, as shown in FIG. 1. The heads 16 can be connected to opposite ends of the main portion 15 by a suitable means such as welds.

The vessel 10 also includes a personnel access provision in the form of a manway positioned at the bottom of a valve box 17. The valve box 17 can be mounted on top of the main portion 15 of the shell 14. The valve box 17 can be mounted at other locations on the shell 14 in alternative embodiments including, for example, on the bottom or sides of the main portion 15, or on the heads 16.

Directional terms, such as top, bottom, upper, lower, above, below, horizontal, etc., are used with reference to the component orientations depicted in FIGS. 1-3. These terms are used for illustrative purposes only, and are not intended to limit the scope of the appended claims.

The valve box 17 includes a substantially cylindrical sleeve 18. The sleeve 18 can be accommodated by an opening formed in the main portion 15 of the shell 14, and can be secured to the main portion 15 by a suitable means such as a weld 23. The sleeve 18 is positioned so that the valve box 17 is partially recessed in relation to the outer surface of the main portion 15, as shown in FIGS. 1 and 2. The sleeve 18 can be recessed to a greater or lesser extent than shown in FIGS. 1 and 2 in alternative embodiments.

The sleeve 18 has a cylindrical inner surface 19 that defines a passage 20 through the sleeve 18. The passage 20 can have a diameter that is large enough to facilitate the passage of a human therethrough, so that the internal volume 12 of the vessel 10 can be accessed by way of the sleeve 18. For example, the diameter of the passage 20 can be about 2.5 feet. The sleeve 18 and the passage 20 can each have a shape other than cylindrical in alternative embodiments of the vessel 10. For example, the sleeve 18 and the passage 20 can be square or rectangular when viewed in cross section.

The valve box 17 also includes a bottom assembly 21. The bottom assembly 21 comprises a substantially plate-shaped cover 22, and a substantially ring-shaped projection 24. The projection 24 can be mounted on an upper surface of the cover 22 by a suitable means such as welds. The inner and outer diameters of the projection 24 are approximately equal to the respective inner and outer diameters of sleeve 18.

The bottom assembly 21 of the valve box 17 also includes a substantially cylindrical skirt 28 that encircles a lower portion of the sleeve 18. The skirt 28 can be mounted on the upper surface of the cover 22 by a suitable means such as welding.

A fluid valve 35 is mounted on the cover 22 of the valve box 17. The use of the valve box 17 to accommodate a single fluid valve 35 is disclosed for exemplary purposes only. The valve box 17 can be used to accommodate more than one fluid valve 35 in alternative embodiments. Other alternative embodiments can include a personnel access provision that is substantially identical to the valve box 17, with the exception that the personnel access provision does not include any fluid valves, i.e., the personnel access provision of the alternative embodiment does not function as a valve box.

The projection 24 has an upper surface 36 that is angled in relation to the centerline "C" of the valve box 17, as shown in FIGS. 2 and 3. The sleeve 18 has a bottom surface 40. The bottom surface 40 is positioned directly above the upper surface 36 of the projection 24, so that the angled surface 36 and the bottom surface 40 define a groove 42. The groove 42 can accommodate a weld 44 that secures the projection 24 and the remainder of the bottom assembly 21 to the sleeve 18. The bottom surface 40 of the sleeve 18 can be angled in lieu of, or in addition to the upper surface 36 of the projection 24 in alternative embodiments.

The bottom assembly 21 can be positioned within the vessel 10 during fabrication of the vessel 10. More particularly, the bottom assembly 21 can be positioned within the internal volume 12 of the vessel 10 before one or both of the heads 16 are welded to the main portion 15, because the bottom assembly 21 is too large to fit through the opening in the shell 14 that accommodates the sleeve 18.

The projection 24 can be welded to the sleeve 18 after human access to the internal volume 12 of the vessel 10 is no longer required, to secure the bottom assembly 21 to the sleeve 18. The bottom assembly 21 can be lifted and supported from outside of the vessel 10 before and during the welding process using, for example, lifting straps connected to brackets 52 or other suitable means mounted on the cover 22. The lifting straps are not depicted in the figures, for clarity of illustration.

The skirt 28 can prevent or discourage debris generated by the welding process from entering the internal volume 12 of the vessel 10. Such debris can be a potential source of contamination when the vessel 10 is subsequently used to hold an HP or UHP gas or other specialty materials that need to be maintained at a relatively high level of purity.

The valve box 17 can be used to provide access to the internal volume 12 of the vessel 10 on an as-needed basis, after the vessel 10 has been placed in service. In particular, the weld 44 can be cut using a saw, a torch, or other suitable means, to release the projection 24 and the remainder of the bottom assembly 21 from the sleeve 18. The skirt 28 can prevent or discourage debris from the weld 44 from entering the internal volume 12 as the weld 44 is cut. In particular, the inner diameter of the skirt 28 can be sized so that a continuous or semi-continuous pocket 31 is formed between skirt 28 and the sleeve 18, as shown in FIG. 2. Alternatively, or in addition, pockets 32 can be formed in the skirt 18 itself. The pockets 31 and/or the pockets 32 can catch the debris from the weld 44 as the weld 44 is cut.

The skirt 28 and bottom assembly 21, upon being released, can be supported and lowered into the internal volume 12 using lifting straps and the brackets 52. The internal volume 12 can subsequently be accessed by way of the passage 20 of the sleeve 18.

The projection 24 of the skirt 28 can be re-welded to the sleeve 18 in the above-discussed manner after human access to the internal volume 12 of the vessel 10 is no longer required, and after the remnants of the original weld 44 have been removed.

If necessary, the vessel 10 can be decontaminated after the projection 24 of the skirt 28 has been re-welded to the sleeve 18, to return the vessel 10 to a condition suitable for holding an HP or UHP gas or other specialty material.

The valve box 17 facilitates human access to the internal volume 12 of the vessel 10, and can thereby eliminate the need for a manway. The valve box 17 does not rely on the use of seals or gaskets to isolate the internal volume 12 within the vessel 10 from the ambient environment, in contradistinction to a manway; rather, the connections between the various major components of the valve box 17 are airtight welds. Thus, it is believed that the potential for leakage into or out of the internal volume 12 of the vessel 10 through the valve box 17 is substantially less than the potential for leakage through a comparably-sized manway, particularly where the vessel 10 is subjected to the mechanical shocks, vibrations, and temperature swings that can occur during transportation of the vessel 10.

The welded connections between the major components of the valve box 17 are believed to make the valve box 17 particularly well suited for applications in which human access to the internal volume 12 of the vessel 10 is not required on a frequent and/or regular basis. For example, devices for performing inspections, repairs, and other operations within vessels are described in co-pending U.S. Patent Application titled "Devices and Methods for Performing Inspections, Repairs, and/or Other Operations Within Vessels," filed Nov. 26, 2007, U.S. Ser. No. 11/944,669, the contents of which is incorporated by reference herein in its entirety. The use of the devices disclosed in the preceding application can eliminate the need for regular human access to the interiors of vessels such as the vessel 10. Vessels such as the vessel 10 can therefore be equipped with a valve box such as the valve box 17 in lieu of a manway (and its potential for leakage), to facilitate occasional human access to the interior of the vessels on an as-needed basis.

Figure 4:
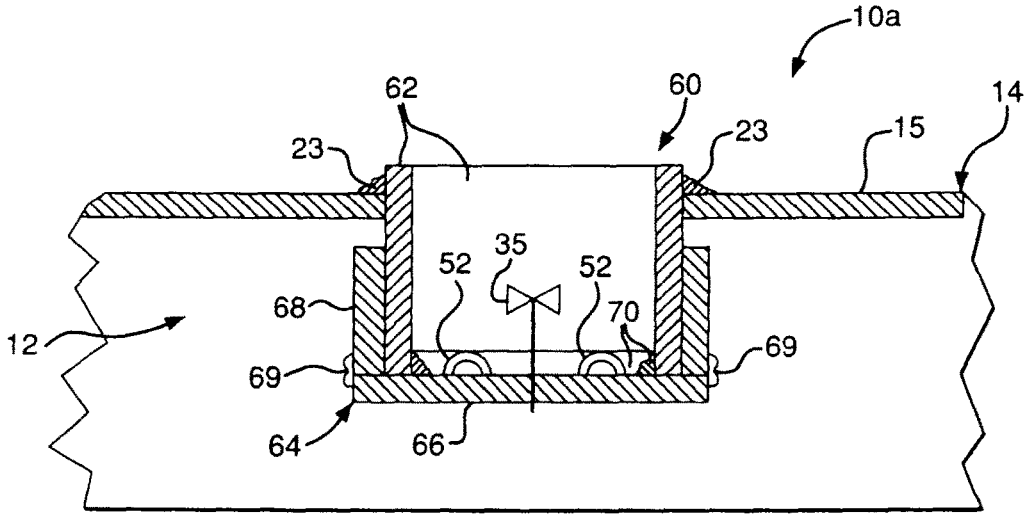
FIG. 4 is a cross-sectional view of a portion of a first alternative embodiment of the vessel shown in FIGS. 1-3, taken from the same perspective as FIG. 2.

Alternative embodiments of the valve box 17 can be configured without the groove 42. For example, FIG. 4 depicts an alternative embodiment of the vessel 10 in the form of a vessel 10*a*. The vessel 10*a* includes a valve box 60 in lieu of the valve box 17. The vessel 10*a* is otherwise substantially identical to the vessel 10. Components of the vessel 10*a* that are substantially identical to those of the vessel 10 are denoted in the figures by identical reference characters.

The valve box 60 includes a substantially cylindrical sleeve 62, and a bottom assembly 64. The sleeve 62 can be accommodated by an opening formed in the main portion 15 of the shell 14, and can be secured to the main portion 15 by a suitable means such as a weld 23.

The bottom assembly 64 includes a cover 66, and a substantially cylindrical skirt 68 mounted on the upper surface of the cover 66 by a suitable means such as a weld 69. The cover 66 can be secured directly to a bottom surface of the sleeve 62 as shown in FIG. 4, by a suitable means such as a weld 70 that extends along the inner circumference of the skirt 68. The sleeve 62 and the skirt 68 can each have a shape other than cylindrical in alternative embodiments. For example, the sleeve 62 and the skirt 68 can each have a square or rectangular cross section in alternative embodiments.

A fluid valve 35 can be mounted on the cover 66 of the valve box 60. The valve box 60 can be used to accommodate more than one fluid valve 35 in alternative embodiments. Other alternative embodiments can include a personnel access provision that is substantially identical to the valve box 60, with the exception that the personnel access provision does not include any fluid valves.

The cover 66 of the valve box 60 can be disconnected from the sleeve 62 when human access to the internal volume 12 of the vessel 10*b* is required. The cover 66 can be disconnected by, for example, cutting or otherwise severing the weld 70 between the cover 66 and the sleeve 62. The cover 66 can be supported and lowered during and after the cutting process using lifting straps, and brackets 52 mounted on the cover 66.

Figure 5:
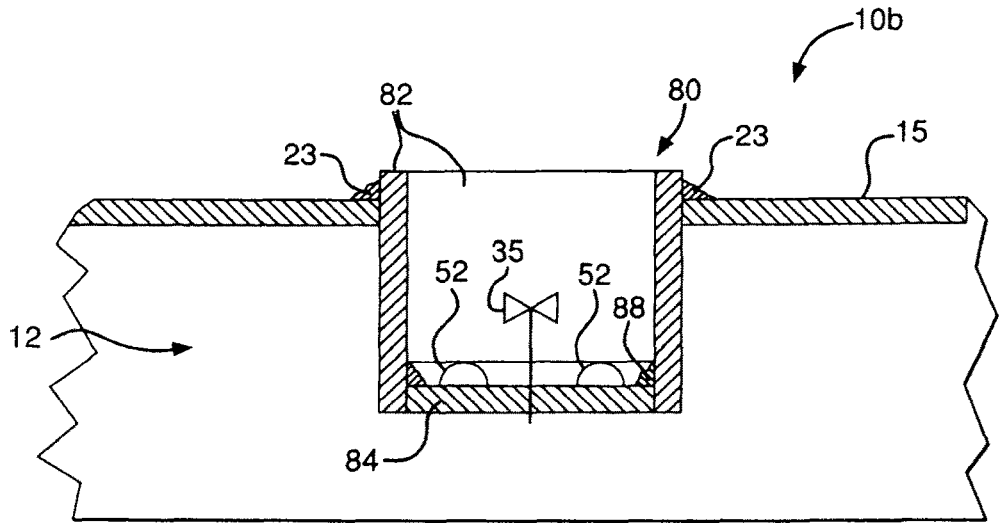
FIG. 5 is a cross-sectional view of a portion of a second alternative embodiment of the vessel shown in FIGS. 1-3, taken from the same perspective as FIG. 2.

Other alternative embodiments of the valve box 17 can be can be configured without a skirt. For example, FIG. 5 depicts an alternative embodiment of the vessel 10 in the form of a vessel 10*b*. The vessel 10*b* includes a valve box 80 in lieu of the valve box 17. The vessel 10*b* is otherwise substantially identical to the vessel 10.

The valve box 80 includes a substantially cylindrical sleeve 82. The sleeve 82 can be accommodated by an opening formed in the main portion 15 of the shell 14, and can be secured to the main portion 15 by a suitable means such as a weld 23.

The valve box 80 also includes a cover 84. The cover 84 can be mounted on the sleeve 82 by a suitable means such as a weld 88 that extends around the inner circumference of the sleeve 82. The sleeve 82 can have a shape other than cylindrical in alternative embodiments. For example, the sleeve 82 can have a square or rectangular cross section in alternative embodiments.

A fluid valve 35 can be mounted on the cover 84 of the valve box 80. The valve box 80 can be used to accommodate more than one fluid valve 35 in alternative embodiments. Other alternative embodiments can include a personnel access provision that is substantially identical to the valve box 80, with the exception that the personnel access provision does not include any fluid valves.

The valve box 80 can be disconnected and removed from the main portion 15 of the shell 14 of the vessel 10 when human access to the internal volume 12 of the vessel 10*b* is required. In particular, the weld 23 can be cut, and the sleeve 82 and the attached cover 84 can then be lifted using, for example, lifting straps and brackets 52 mounted on the cover 84. Access to the internal volume 12 can subsequently be obtained through the opening in the main portion 15 that accommodates the sleeve 80.

Figure 6:
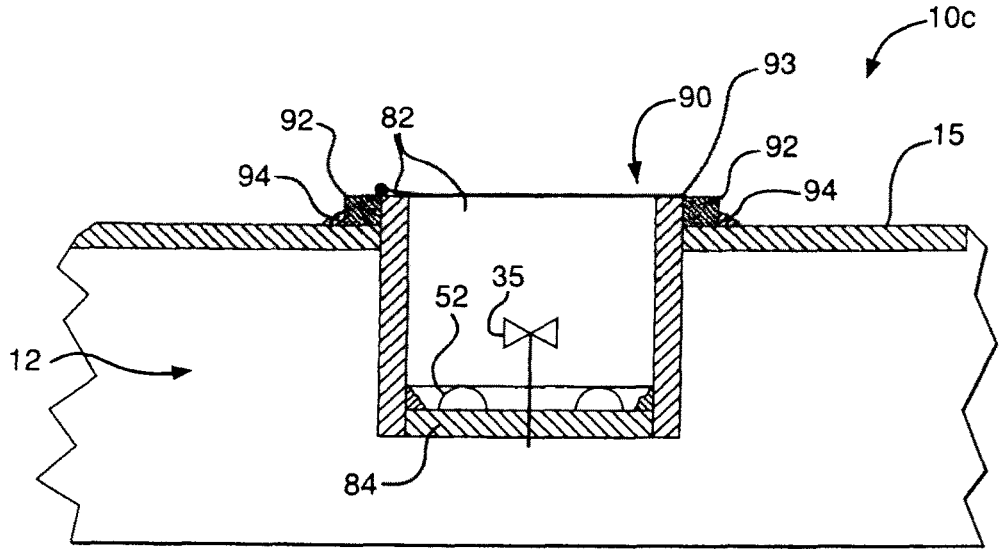
FIG. 6 is a cross-sectional view of a portion of a third alternative embodiment of the vessel shown in FIGS. 1-3, taken from the same perspective as FIG. 2.

FIG. 6 depicts another alternative embodiment of the vessel 10 in the form of a vessel 10*c*. The vessel 10*c* includes a valve box 90. The valve box 90 is substantially identical to the valve box 80 of the vessel 10*b*, with the following exception: the valve box 90 includes a support in the form of a ring 92 positioned around an upper end of the sleeve 82 and secured to the sleeve 82 by a suitable means such as a weld 93. Components of the valve box 90 that are substantially identical to those of the valve box 80 are denoted in the figures by identical reference characters.

The valve box 90 can be secured to the main portion 15 of the shell 14 by a weld 94 that extends around the outer circumference of the ring 92. The valve box 90 can be disconnected and removed from the main portion 15 of the shell 14 of the vessel 10*c* when human access to the internal volume 12 of the vessel 10*c* is required. In particular, the weld 94 can be cut, and the sleeve 82, the attached cover 84, and the ring 92 can be lifted, for example, using lifting straps and brackets 52 mounted on the cover 84. Access to the internal volume 12 can subsequently be obtained through the opening in the main portion 15 that accommodates the sleeve 80. The ring 92 locates the weld 94 away from the opening, and can thereby prevent or discourage debris generated by the welding process from entering the internal volume 12 of the vessel 10*c*.

Figure 7:
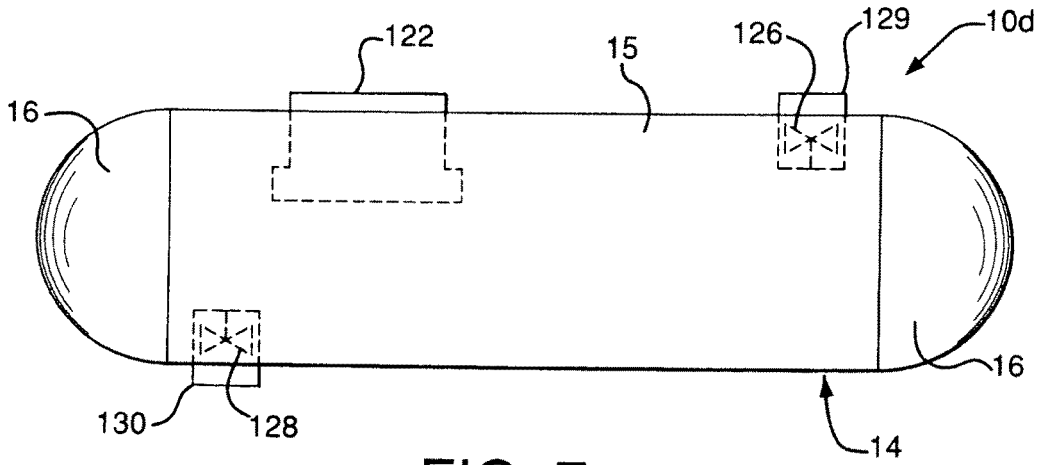
FIG. 7 is a side view of a fourth alternative embodiment of the vessel shown in FIGS. 1-3.

Alternative embodiments of the valve boxes 17, 60, 80, and 90, as noted above, can be configured without valves, and can function solely as personnel-access provisions. For example, FIG. 7 depicts a vessel 10*d* that is equipped with a personnel access provision 122 that is substantially identical to the valve box 17, with the exception that the personnel access provision 122 does not include any valves. The depth or height of the personnel access provision 122, unlike that of the valve box 17, is not limited or otherwise restricted by the need to accommodate valves. Components of the vessel 10*d* that are substantially identical to those of the vessel 10 are denoted in the figures by identical reference characters.

As discussed above, conventional valve boxes may be configured with a manway, so that a single blanket of non-contaminating gas can be used to reduce or eliminate the potential for ambient air to infiltrate into the vessel due to leakage past the manway and the valves located in the valve box.

The potential for leakage through the personnel access provision 122 is believed to be substantially eliminated due to the welded construction of thereof. Thus, it is not necessary to maintain a blanket of non-contaminating gas within the personnel access provision 122. The above-noted advantage of locating valving and a personnel access provision in a common valve box therefore does not exist when the personnel access provision 122 is used. The valving can therefore be located in one or more relatively small valve boxes placed in convenient or otherwise advantageous locations throughout the vessel 10*d*.

For example, the vessel 10*d* includes a first fluid valve 126 and a second fluid valve 128. The first fluid valve 126 is mounted in a first valve box 129 located at the top of the shell 15 of the vessel 10*d*. The second fluid valve 128 is mounted in a second valve box 130 located at the bottom of the shell 15 of the vessel 10*d*.

The first and second valve boxes 128, 129 do not need to accommodate a personnel access provision, because personnel access to the interior volume 12 of the vessel 10*d* is provided by the personnel access provision 122. The first and second valve boxes 129, 130 are sized to accommodate only the respective first fluid valve 126 and second fluid valve 128, and are therefore relatively compact in relation to a valve box that also accommodates a personnel access provision such as a manway.

Figure 8:
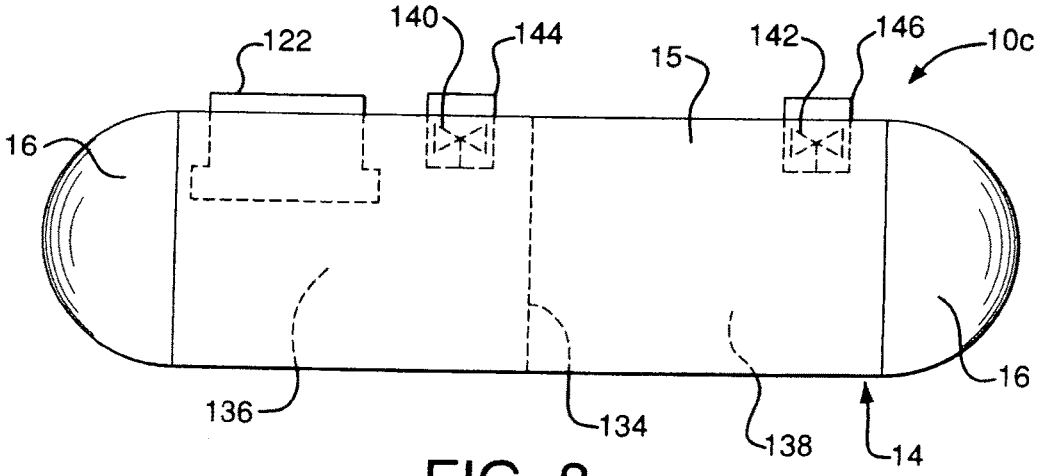
FIG. 8 is a side view of a fifth alternative embodiment of the vessel shown in FIGS. 1-3.

FIG. 8 depicts another alternative embodiment in the form of a vessel 10*e*. Components of the vessel 10*e* that are substantially identical to those of the vessel 10 are denoted in the figures by identical reference characters.

The vessel 10*e* includes an internal wall 134 that divides the internal volume of the vessel 10*e* into a first compartment 136 and a second compartment 138. The internal wall has an access opening (not shown) that is normally covered by a hatch (also not shown) mounted on the internal wall 134.

The vessel 10*e* also includes a first fluid valve 140 and a second fluid valve 142. The first fluid valve 140 is mounted in a first valve box 174 mounted on the shell 15 of the vessel 10*e* so that the first fluid valve 140 is in fluid communication with the first compartment 136. The second fluid valve 142 is mounted in a second valve box 176 mounted on the shell 15 so that the second fluid valve 142 is in fluid communication with the second compartment 138. Personnel access to the first compartment 136 can be provided by a personnel access provision 122 mounted on the shell 15. Personnel access to the second compartment 138 can be obtained, for example, by accessing the first compartment 136 and opening the hatch on the internal wall 134.

Figure 9:
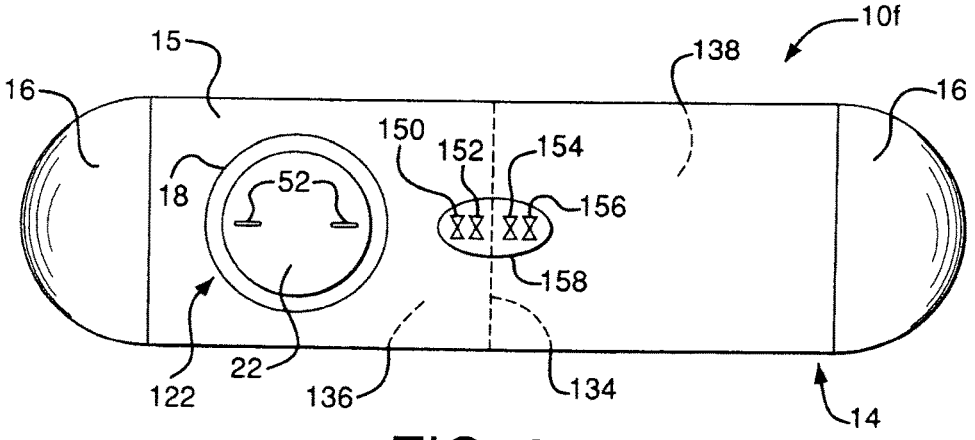
FIG. 9 is a top view of a sixth alternative embodiment of the vessel shown in FIGS. 1-3.

FIG. 9 depicts another alternative embodiment in the form of a vessel 10*f*. The vessel 10*f* is substantially identical to the vessel 10*e*, with the following exceptions. Components of the vessel 10*f* that are substantially identical to those of the vessel 10*e* are denoted in the figures by identical reference characters.

The vessel 10*f* includes a first fluid valve 150, a second fluid valve 152, a third fluid valve 154, and a fourth fluid valve 156. The vessel 10*f* also includes a valve box 158. The first, second, third, and fourth fluid valves 150, 152, 154, 156 are arranged linearly within the valve box 158. The valve box 158 is mounted on the shell 15 of the vessel 10*f* so that the first and second fluid valves 150, 152 are in fluid communication with the first compartment 136, and the third and fourth fluid valves 154, 156 are in fluid communication with the second compartment 138. The valve box 158 has a substantially elliptical shape, to accommodate the linear arrangement of the first, second, third, and fourth fluid valves 150, 152, 154, 156. The valve box 158 can have other shapes suitable for accommodating a linear arrangement of valves in alternative embodiments.

Figure 10:
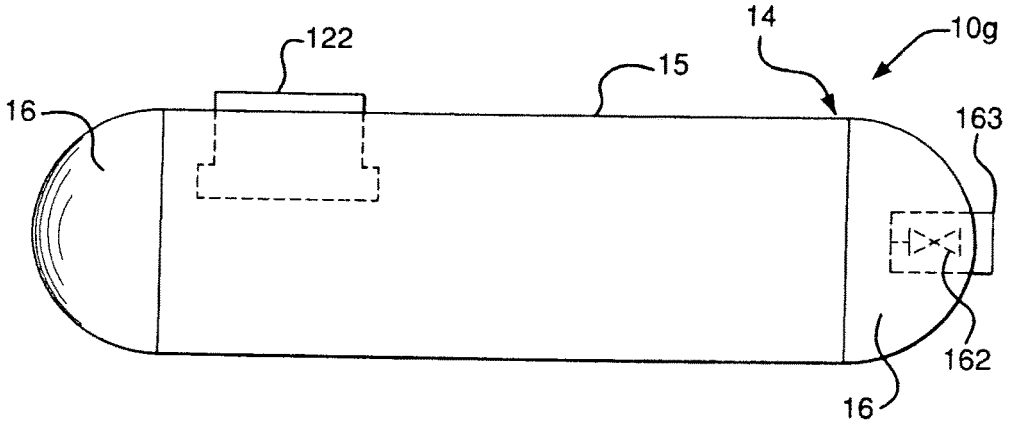
FIG. 10 is a side view of a seventh alternative embodiment of the vessel shown in FIGS. 1-3.

FIG. 10 depicts another alternative embodiment in the form of a vessel 10*g*. Components of the vessel 10*g* that are substantially identical to those of the vessel 10 are denoted in the figures by identical reference characters.

The vessel 10*g* includes an access provision 122 mounted on the main portion 15 of the shell 14 of the vessel 10*g*. The vessel 10*g* also includes a fluid valve 162 accommodated by a valve box 163 mounted on one of the heads 16 of the shell 14.

Other vessel configurations are possible based on the specific requirements for a particular application. For example, three fluid can be mounted within a single valve box in a triangular pattern; four fluid valves can be mounted within a single valve box in a square or rectangular pattern, etc.

Other alternative embodiments can include personnel access provisions in which the cover is connected to an upper surface of the sleeve, so that the cover is located outside of the shell of the vessel.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, can make numerous modifications to the invention as described herein, and changes may be made without departing from the scope and spirit of the invention as defined by the appended claims.

The invention claimed is:

1. A transportable vessel capable of holding and transporting high-purity and ultra-high-purity gases, comprising:

a shell defining an internal volume; said shell having an inner surface and an outer surface;

a hollow sleeve mounted on and extending through an opening in the shell;

a cover permanently connected to an end of the sleeve, and a support welded to an outer surface of the sleeve and the outer surface of the shell;

wherein the support locates the weld between the support and the outer surface away from said opening to prevent or discourage debris generated by the welding process from entering the internal volume when the weld is cut to remove the support, the sleeve and the cover to gain access to the opening.

2. The vessel of claim 1, wherein the cover is welded to the end of the sleeve.

3. The vessel of claim 1, wherein the end of the sleeve is located within the internal volume of the shell.

4. The vessel of claim 1, further comprising a valve mounted on the cover.

5. The vessel of claim 1, wherein the sleeve defines a passage extending between the internal volume and outside of the vessel, and the passage has a width or a diameter of approximately 2.5 feet or more.

6. The vessel of claim 1, wherein the cover isolates the internal volume from an ambient environment outside of the vessel.

7. The vessel of claim 2, further comprising a projection mounted on the cover; wherein the sleeve and the projection define a groove, and a weld that connects the cover and the sleeve is located at least in part within the groove.

8. The vessel of claim 2, wherein the sleeve is substantially cylindrical and the support is substantially ring shaped.

9. A method for accessing an internal volume of a transportable vessel, the vessel comprising a shell that defines an internal volume, said shell having an inner surface and an outer surface, a sleeve mounted on the shell and extending through an opening in the shell, and defining a passage from outside of the vessel to the internal volume, a cover connected to an end of the sleeve by a weld, and a support welded to an outer surface of the sleeve and an outer surface of the shell, the method comprising:

cutting the weld between the outer surface of the shell and the support, wherein the support locates the weld between the support and the outer surface away from said opening to prevent or discourage debris generated by the welding process from entering the internal volume;

moving the cover, the sleeve and the support away from the passage; and entering the internal volume by way of the passage.

10. The method of claim 9, wherein moving the cover away from the passage comprises lifting the cover, the sleeve and the support.

11. The method of claim 9, wherein the cover is welded to the end of the sleeve.

12. The method of claim 9, wherein the end of the sleeve is located within an internal volume of the shell.

13. The method of claim 9, wherein a valve is mounted on the cover.

14. The method of claim 9, the sleeve defines a passage extending between the internal volume and outside of the vessel, and the passage has a width or a diameter of approximately 2.5 feet or more.

15. The method of claim 9, wherein the cover isolates the internal volume from an ambient environment outside of the vessel.

16. The method of claim 9, further comprising a projection mounted on the cover; wherein the sleeve and the projection define a groove, and a weld that connects the cover and the sleeve is located at least in part within the groove.

17. The method of claim 9, wherein the sleeve is substantially cylindrical and the support is substantially ring shaped.

18. The vessel of claim 1 wherein the cover further comprises brackets for lifting straps.

19. The vessel for claim 9, wherein said cover comprises brackets for lifting straps and prior to said moving step is the step of attaching lifting straps to said brackets.

* * * * *